United States Patent [19]

Hashimoto

[11] 4,362,410

[45] * Dec. 7, 1982

[54] MECHANICAL PENCIL

[75] Inventor: Yasuyuki Hashimoto, Nishinomiya, Japan

[73] Assignee: Ancos Co., Ltd., Osaka, Japan

[ * ] Notice: The portion of the term of this patent subsequent to Aug. 19, 1997, has been disclaimed.

[21] Appl. No.: 152,958

[22] Filed: May 23, 1980

[30] Foreign Application Priority Data

Apr. 21, 1980 [JP] Japan ..... 55/53196[U]

[51] Int. Cl.[3] ..... B43K 21/22

[52] U.S. Cl. ..... 401/67

[58] Field of Search ..... 401/67

[56] References Cited

U.S. PATENT DOCUMENTS

| | | | |
|---|---|---|---|
| 3,537,799 | 11/1970 | Skamoto | 401/67 |
| 3,724,960 | 4/1973 | Hashimoto et al. | 401/67 |
| 3,765,781 | 10/1973 | Hashimoto et al. | 401/67 |
| 3,864,046 | 2/1975 | Butka | 401/67 |
| 4,106,874 | 8/1978 | Torii | 401/67 |
| 4,218,153 | 8/1980 | Hashimoto | 401/67 |
| 4,264,227 | 4/1981 | Iwasaki | 401/67 |

FOREIGN PATENT DOCUMENTS

| | | | |
|---|---|---|---|
| 2153400 | 5/1973 | Fed. Rep. of Germany | 401/67 |
| 2912408 | 10/1979 | Fed. Rep. of Germany | 401/67 |
| 2820099 | 11/1979 | Fed. Rep. of Germany | 401/67 |

*Primary Examiner*—William Pieprz

*Attorney, Agent, or Firm*—Sughrue, Mion, Zinn, Macpeak & Seas

[57] ABSTRACT

A rotational slide type mechanical pencil having front and rear relatively rotatable bodies with a lead case disposed therein. A chuck which is rigidly coupled to the case firmly grips the lead in writing positions of the pencil. A chuck tightening member is provided having a chuck receiving portion which engages and tightens the chuck. A slider which is movable back and forth through a predetermined distance and is disposed forwardly of the chuck frictionally grips the lead. A conversion mechanism is provided for converting rotational movement of the rear axial body to linear movement of the chuck tightening member whereby the rotational movement of the second body moves the slider forwardly extending a portion of the slider through the front opening of an axial hollow body and extending the lead therethrough.

7 Claims, 14 Drawing Figures

MECHANICAL PENCIL

BACKGROUND OF THE INVENTION

The present invention relates to a rotary slide type mechanical pencil in which an axial body member is rotated to advance and extend a slider holding a lead to a writing position.

U.S. patent application Ser. No. 25,525 filed on Mar. 30, 1979, issued on Aug. 19, 1980 as U.S. Pat. No. 4,218,153 and entitled "Mechanical Pencil", directed to a rotary slide type mechanical pencil of this general type, was previously filed by the present applicant. More particularly, this patent relates to a mechanical pencil in which the pencil body is divided into front and rear axial bodies. When either axial body is rotated relative to the other, a chuck tightening member is advanced and engages with a lead chuck to grip the lead and thereafter the chuck clamping the lead is advanced. The mechanical pencil further includes a lead holding retainer disposed in front of the chuck and a slider movable through a predetermined fixed distance. With this construction, when either of the axial bodies is rotated, the tightening member is advanced and engages with the chuck and thereafter the lead clamped by the chuck is further advanced with the tightening member engaged with the chuck whereby lead is supplied from an opening of the slider which has been advanced and stopped at the advanced position during a single continuous rotation. To retract the slider, the axial body is rotated in the opposite direction. However, in this mechanical pencil, when the lead extends from the opening of the slider and the slider is retracted when this lead has not been written with to wear out the lead, during the next use additional lead is supplied adding to the extended lead length. Thus, excessive lead length is added to the lead held by the slider. This tends to cause a lead breakage and results in inconvenient and excessive operation. If the pencil is so designed that in the retracted state the front end of the slider and the front end of the mouth member, that is, the forward-most end of the pencil body, coincide with each other while at the same time the rear end of the slider abuts the chuck so that the chuck is disposed forwardly, it is possible to avoid the above-noted defect and to retract the excessive lead into the slider by pressing the end of the lead against a solid surface. In this case, since the lead is not gripped by the chuck, the lead is easily retracted into the slider.

However, with such a design or construction, there is yet another problem. Since the position of the chuck for writing is further forward than the position of the chuck in the retracted state, the lead extends forwardly from the opening of the slider a length equal to the difference between these positions. In this case, the slider cannot be retracted into the mouth during writing. This is due to the fact that the rear end of the slider abuts against the chuck so that the front portion of the slider is left extending from the opening of the mouth member. This causes the paper to be torn by the stopped slider during continuous writing.

In order to remedy the above-noted defects, it is an object of the present invention to provide a rotational slide mechanical pencil in which excessive lead supply from a front end of the slider is prevented when the slider is advanced from the retracted state to the writing state while at the same time the slider can be fully retracted into the mouth member in the writing state.

SUMMARY OF THE INVENTION

This, as well as other objects of the invention, are met by a rotational slide type mechanical pencil including an axial hollow body composed of first and second hollow bodies which are connected rotatable relative to one another. A lead case for storage of extra leads is disposed within the hollow axial body. A chuck is provided for firmly clamping a lead during writing with the chuck rigidly coupled to the lead case. A chuck tightening member also provided within the axial body engages and tightens the chuck. Slider means, which is movable back and forth through a predetermined distance along the axial body and disposed in front of the chuck, frictionally grips the lead. A conversion mechanism is provided for converting rotational movement of the second axial body to linear movement of the chuck tightening member whereby rotational movement of the second axial body relative to the first axial body moves the slider means forwardly extending a portion of the slider means from a front opening of the axial hollow body.

In one preferred embodiment, the hollow body is provided with a hollow space in which the chuck tightening member is movable between first and second positions through the predetermined distance. The chuck tightening member is biased towards the first position. A hollow cylindrical sleeve is provided extending forwardly from a front end of the chuck tightening member and the hollow cylindrical sleeve is constructed so as to frictionally retain the slider in a front portion of the hollow cylindrical sleeve. The chuck in the first position is disengaged from the chuck tightening member while the chuck in the second position is engaged with the chuck tightening member. Also, in the second position in this embodiment, the slider means is fully retractable into the hollow body. The slider means may be provided with retaining means which abuts the front portion of the hollow cylindrical sleee to restrain movement of the slider means forwardly beyond the second position.

In another preferred embodiment of the invention, the chuck tightening member is made movable between first and second positions in a hollow space provided in the hollow axial body and the chuck is biased rearwardly, such as by a spring, in the lead case. A hollow cylindrical sleeve is provided extending from a front end of the chuck tightening member with the hollow cylindrical sleeve frictionally retaining the slider at a front portion thereof. The chuck in the first position is disengaged from the chuck tightening member whereas the chuck in the second position is engaged with the chuck tightening member. The slider in this embodiment is adapted to abut against an inner portion of the axial body when the chuck tightening member is advanced forwardly before the chuck tightening member reaches the second position to thereby extend new lead through a front opening in the axial body. The frontmost end of the axial body and the front end of the slider means coincide with each other in the first position while the slider is fully retractable into the axial body in the second position. An annular member may be disposed inside a front portion of the axial body with the annular member having an inwardly directed annular projection. The slider in this case includes a tip sleeve and a retaining ring member disposed around an outer periphery of the tip sleeve at a position so as to abut the annular projection in the first position.

Still further in accordance with the invention, the chuck may be made rotatable in response to rotation of the second body. In this case, the chuck is provided with an extension rod extending from the front end of the chuck with the extension rod being adapted to abut the rear end of the slider means at the first position. The slider means is then provided with an engagement hole which is adapted to receive the extension rod in the second position.

The chuck may be self-biased to be open and abut against the rear end of the slider means in the first position. In this case, the slider means is provided with a concave portion which is adapted to receive the front end portion of the chuck. The chuck is insertable into the concave portion of the slider means at the second position.

DESCRIPTION OF THE PREFERRED EMBODIMENTS

Figure 1:
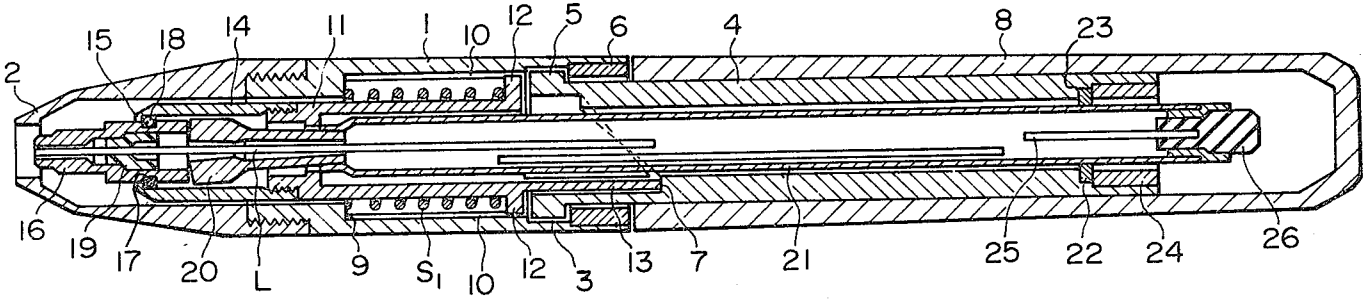
FIG. 1 is a longitudinal cross-sectional view of a first embodiment of a mechanical pencil constructed according to the present invention.

The present invention will be described with reference to the accompanying drawings. FIG. 1 is a longitudinal cross-sectional view showing a first embodiment of a mechanical pencil constructed according to the present invention shown in a storage configuration, that is, not in use. As shown, lead is stored within the pencil body and fed from the rear. A mouth member or piece 2 is fixedly and threadedly engaged with a front portion of a front axial body 1. A rotary cylinder 4 is positioned at a rear inner portion of the main body 1 abutting a shoulder portion 3 formed on the front body 1. A flange portion 5 is formed at a front end of the rotary cylinder 4. Further, a retaining ring 6 is press-fitted into the rear inner end portion of the front body 1 to thereby prevent disengagement of the front body 1 from the rotary cylinder 4. A slant cam surface 7 is formed at a front inner portion of the rotary cylinder 4 as best shown in FIG. 2B. The rotary cylinder 4 is substantially surrounded by a rear axial body 8 with the rear axial body 8 and the rotary cylinder 4 rotating together. The body of the mechanical pencil is composed of the mouth member 2, the front axial body 1 and the rear axial body 8.

An annular shouldered portion 9 is formed along an inner surface of the front body 1. Longitudinal guide grooves 10 extend rearwardly from the shouldered portion 9. A chuck tightening member 11 is disposed in the front axial body 1. Projections 12 which are formed at a peripheral end surface of the tightening member 11 are slidably disposed in the longitudinal grooves 10 to thereby prevent rotation of the chuck tightening member 11.

Figure 2A:
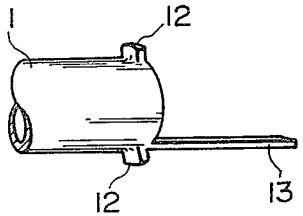
FIG. 2A is a side view of a chuck tightening member used in the pencil of FIG. 1.
Figure 2B:
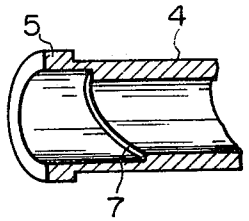
FIG. 2B is a cross-sectional enlarged view of a rotary cylinder used in the pencil of FIG. 1.

As shown in FIG. 2A, a rod portion 13 extends from the rear end of the tightening member 11. As a result of the rotation of the rotary cylinder 4, the rear end of the rod portion 13 slides along the slant cam surface 7 and the rod portion 13 moves forwardly and backwardly. A spring $S_1$ is disposed between the shoulder portion 9 of the front body 1 and the projections 12 of the tightening member 11 to bias the tightening member 11 backwardly.

A cylindrical sleeve 14 is threadedly engaged with the tightening member 11. A shoulder portion 15 is formed at the front inner portion of the cylindrical sleeve 14. A slider 16 is provided extending through the hollow portion of the cylindrical sleeve 14. An annular groove 17 into which an annular retaining member 18 made of elastic material is received is formed in an outer periphery of the slider 16. The retaining member 18 is positioned behind the shoulder portion 15 and serves to lightly hold the cylindrical sleeve 14 upon the inner surface thereof. A lead retainer 19 is disposed within the slider 16. The lead retainer 19, made of an elastic material such as rubber or synthetic resin, maintains a light pressure on the lead. The slider 16 is dimensioned to be able to project from the opening at the top end of the mouth member 2 and the cylindrical sleeve 14. Many modifications of the structures of the cylindrical sleeve 14, the slider 16 and the tightening member 11 can be used within the scope of the invention.

A lead gripping chuck 20 is disposed within the cylindrical sleeve 14 and the tightening member 11. A rear end of the chuck 20 is rigidly coupled to a lead case 21. An annular ring 22 is secured to the outer rear periphery of the lead case 21. The annular ring 22 is in abutment with a shoulder portion 23 formed in an inner rear periphery of the rotary sleeve 4. A stopper ring 24 is pressingly inserted into the inner periphery of the rotary sleeve 4 from the rear side of the annular ring 22 to prevent the chuck 20 and the lead case 21 from moving back and forth. An eraser 26 having a cleaner pin 25 is provided in a rear opening of the lead case 21.

In the retracted position shown in FIG. 1, the tightening member 11 and the cylindrical sleeve 14 are at their most rearward position due to the force of the spring $S_1$. In this position the sleeve 14 allows the slider 16 to move to it farthest rearward position along with the retainer 18. At this time, the rear end of the slider 16 abuts against the front end of the chuck 20. In this case, it should be noted that the lead is released from the chuck 20 because the chuck 20 is disengaged from the tightening member 11.

To change to the writing state of the thus constructed mechanical pencil, the rear axial body 8 surrounding the rotary sleeve 4 is rotated by one hand with the front axial body held by the other hand while the tip end of the mechanical pencil is directed downwardly. When the rotary sleeve 4 is rotated together with the rear body 8, the rear end of the extension rod 13 is slidingly pushed forwardly by the slant surface 7 thereby advancing the tightening member 11 and the cylindrical sleeve 14 and thus compressing the spring $S_1$. During this movement, the projections 12 guide the tightening member 11 by sliding engagement with the guide grooves 10 to thereby prevent the tightening member 11 and cylindrical sleeve 14 from rotating. When the cylindrical member 14 is advanced, the slider 16 is advanced therewith due to the light frictional engagement between the slider 16 and the retainer 18. Since the lead is not at that point clamped by the chuck, it drops by force of gravity until it abuts against the front end of the retainer 19. In this state, the lead is advanced together with the slider 16.

Then, after the slider 16 has fully advanced and projects outward from the opening of the mouth member 2, the tightening member 11 engages with the chuck 20 causing it to grip the lead. If the front end of the slider 16 extending from the mouth member 2 in this state is returned into the mouth member 2 by pushing it against a solid surface, the front end of the lead which was in abutment with the end of the lead retainer 19 is inserted into the lead retainer 19.

Subsequently, the rear body 8 is rotated in the opposite direction to return to the position shown in FIG. 1, that is, the retracted state. Following this, the rear body is again rotated in the first direction to once more extend the slider 16 through the mouth member 2 in the same manner as mentioned above. This operation is repeated two or three times until the front-most end of the lead reaches the front end of the slider 16 to thereby attain the state shown in FIG. 3. In this state, the rear end of the extension rod 13 is in its forward-most position and at the forward-most end of the slant cam surface 7. Hence the rotary sleeve 4 cannot be further rotated. The forward-most end of the slant cam surface 7 may be made flat to positively retain the extension rod 13 to further provide stable operations.

Figure 3:
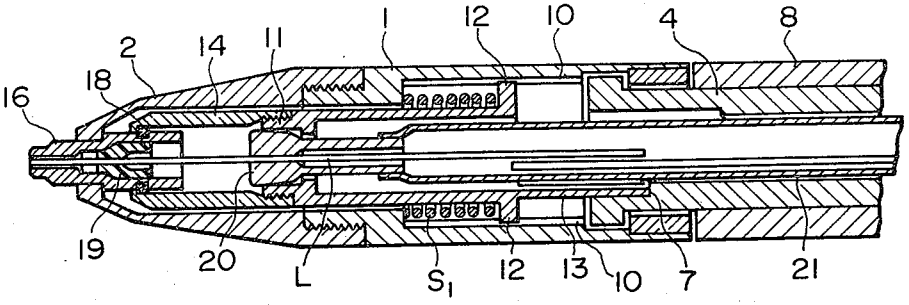
FIG. 3 is a cross-sectional view of the pencil shown in FIG. 1 in a writing state.

When writing is carried out in the position shown in FIG. 3, as the lead is worn down, force is exerted on the slider 16 due to the normal writing pressure. Writing is possible until the slider 16 becomes fully retracted into the mouth member 2. The slider 16 thus serves to protect the lead from breakage.

In order to return to the retracted state, the rear axial body 8 is rotated in the second or opposite direction. By action of the spring $S_1$, the tightening member 11 and the cylindrical sleeve 14 are moved rearwardly as is the slider 16. After the rear end of the slider 16 has come into abutment with the front end of the chuck 20, the slider 16 and the retainer 18 are stopped whereas the sleeve 14 continues to move backward. Finally, the state shown in FIG. 1 is reached.

In this embodiment of the mechanical pencil of the invention, in the writing state or position, the front end of the lead is always aligned with the front end of the slider 16 with both the lead and the slider 16 protruding from the front of the mouth member 2. It is impossible to forcibly extend the lead from the front end of the slider 16. When the writing continues in the state shown in FIG. 3, the slider 16 can be fully retracted into the mouth member 2. Also, since the lead is released by the chuck 20 in the retracted state shown in FIG. 1, it is possible to effectively avoid lead breakage in the non-use or carrying state.

A second specific embodiment of a mechanical pencil according to the present invention will be described with reference to FIGS. 4 to 7 inclusive. In these figures, like reference characters and numbers have been used to denote like members. A joint member 27 is rigidly coupled to an inner end periphery of the front axial body 1 and a male screw portion formed on the mouth member 2 is threadedly engaged with a female screw portion formed on an inner periphery of the joint member 27 to thereby connect the mouth member 2 and the front axial body 1. A plurality of longitudinal axial grooves 10 are formed in the joint member 27. A first annular ring 29 is inserted into and fixed to an inner rear end periphery of the front body 1. A second annular ring 30 is inserted into and fixed to an inner front end periphery of the rear axial body 8. The ring 30 is rotatable relative to the ring 29. The ring 30 is surrounded by the rear body 8.

Figure 4:
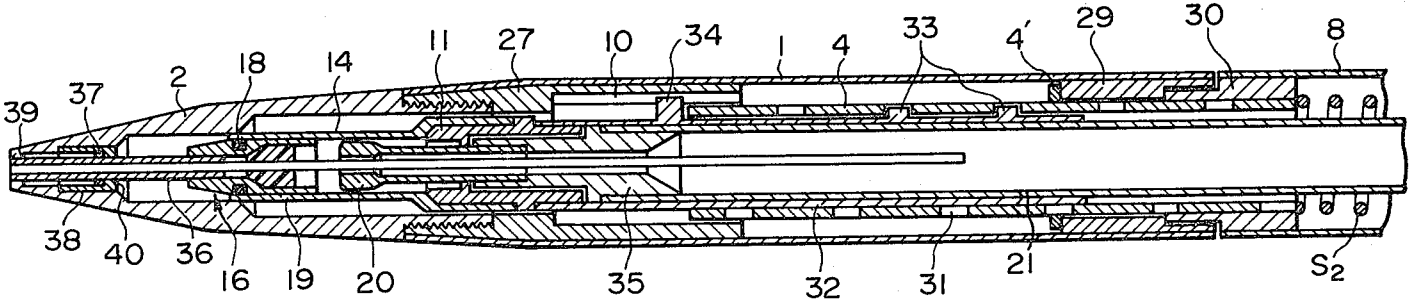
FIGS. 4–7 are longitudinal cross-sectional views of a second embodiment of a mechanical pencil according to the present invention shown in various operational states.

The rear axial body 8 is attachable to and detachable from the ring 30 but rotatable together with the ring 30. To an inner periphery of the ring 30 is secured an outer rear periphery of the rotary sleeve 4 so that both members will rotate together. An annular ring 4' is secured to an outer periphery of the rotary sleeve 4 with the annular ring 4' positioned forwardly of the ring 29 and thus serving to prevent removal of the rotary sleeve 4. A single groove spiral slot is formed in the rotary sleeve. A plurality of projections 33 extending from an outer periphery of a sleeve 32 which is surrounded by the rotary sleeve 4 are engaged at various positions along the spiral slot. Also, a guide projection 34 formed on an outer front end portion of the sleeve 32 is slidingly disposed in a guide groove 28 of the joint member 27. The lead case 21 is disposed inside the sleeve 32. A lead introduction guide member 35 is mounted on the front end of the lead case 21 and the chuck 20 is mounted on the front end of the guide member 35. A tightening member 11 is secured to the front end of the sleeve 32. A cylindrical sleeve 14 is mounted on a front portion of the tightening member 1. In the same manner as used in the first embodiment, a slider 16 is slidably mounted on the cylindrical sleeve 14 with a retainer 18. A ring 37 is rigidly coupled to an outer periphery of a tip sleeve 36 which is in turn connected to the slider 16. An annular member 38 is fixedly positioned within the inner portion of the mouth member 2. The ring 37 fixed to the tip sleeve 36 is movable back and forth a distance defined between a shoulder portion formed at the front end of the mouth member 2 and an annular projection 40 formed at an inner rear periphery of the annular member 38. Between the rear end of the rotary sleeve 4 and the lead case 21 is interposed a spring $S_2$ which biases the chuck 20 and members rigidly coupled thereto rearwardly. A ring (not shown) is fixed to the inner surface of the rear axial body 8 and another ring (not shown) is fixed to an outer periphery of the lead case 21. Various other constructions for this feature are possible. FIG. 4 shows a state in which the ring of the lead case 21 is positioned forward of the ring of the rear axial body 8 and the two rings are in abutment so as to prevent the lead case and other members from moving further rearwardly.

In FIG. 4 showing the state in which the slider 16 is retracted, the front end of the tip sleeve 36 and the front end of the mouth member 2 coincide with each other and there is a small space provided between the rear end of the slider 16 and the front end of the chuck 20. In this state, the ring 37 of the tip sleeve 36 coupled to the slider 16 abuts against the annular projection 40 of the annular member 38 within the mouth member 2 to thereby prevent the slider 16 from moving rearwardly. It should be noted that the chuck 20 in this position is open thereby releasing the lead L. For writing, to extend the lead the rear axial body 8 is rotated with one hand with the front axial body held by the other hand.

As a result, the rotary sleeve 4 is rotated through the annular ring 30. The sleeve 32 is movable back and forth but not rotatable since the guide projection 34 thereon is engaged with the axial sleeve 10 of the joint member 27. Accordingly, when the rotary sleeve 4 is rotated, the spiral slot pushes against the projections 33 and thereby advances the sleeve 32. When the sleeve 32 is advanced, the tightening member 11 and the cylindrical sleeve 14 also move forwardly and the slider 16 advances by movement of the retainer 18.

Figure 5:
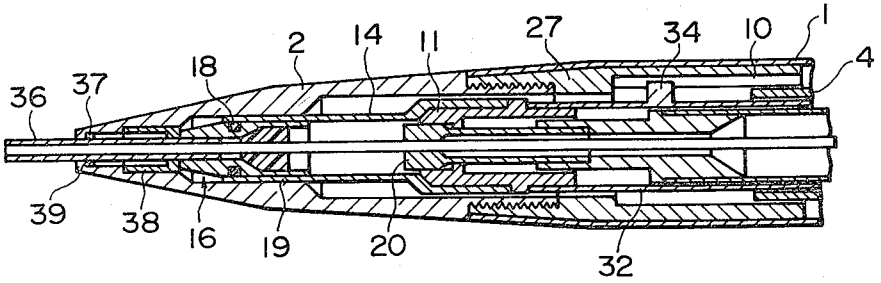

In FIG. 5, showing a position at which the ring 37 of the tip sleeve 36 abuts the shoulder portion 39 of the mouth member 2, the tightening member 11 receives the chuck 20 which then grips the lead. Thereafter, the slider is prevented from moving further forwardly although the chuck 20 engaged with the tightening member 11 can be further advanced whereby new lead is supplied from the front end of the tip sleeve 36 as shown in FIG. 6.

Figure 6:
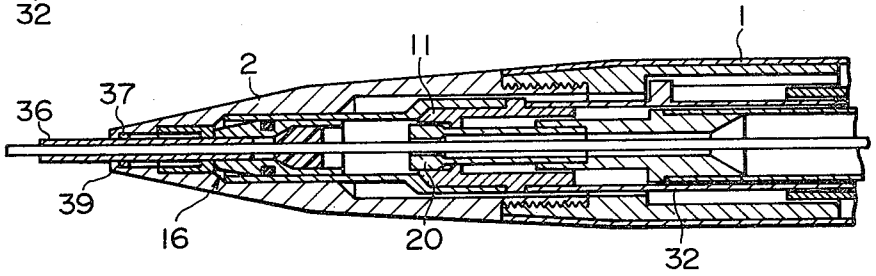
Figure 7:
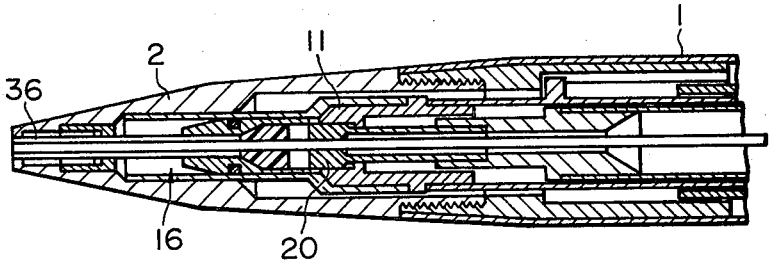

After continuous writing in the state shown in FIG. 6, it is possible to continue writing until the state illustrated in FIG. 7 is reached in which the front ends of the tip sleeve 36 and the mouth member 2 coincide with each other. Though the chuck 20 is in its most forwardly advanced position in FIGS. 6 and 7, the mechanical pencil is so constructed that the distance between the front end of the mouth member 2 and the chuck 20 is equal to or longer than the overall length of the slider 16 including the tip sleeve 36. The state where the writing has been carried out to the fullest extent possible without further advancing the lead is shown in FIG. 7.

To continue writing, the slider 16 is retracted by rotating the rear axial body 8 in the opposite direction. The rotary sleeve 4 is also rotated to thereby retract the sleeve 32, the tightening member 11 and the cylindrical sleeve 14 as well as the slider 16 with the retainer 18. After the ring 37 of the tip sleeve 36 has come into abutment with the annular projection 40 of the annular member 38, the slider 16 is stopped whereas the other members such as the cylindrical sleeve 14, the tightening member 11 and the sleeve 32 continue to move rearwardly. At this time, since the lead is released from the chuck 20, it is left within the slider. The chuck 20, the lead guide member 35 and the lead case 21 are moved rearwardly due by the force of the spring $S_2$ to the positions shown in FIG. 4. Afterwards, when the rear axial body 8 is rotated, the mechanical pencil again reaches the state shown in FIG. 6 passing through the state shown in FIG. 5. It should be noted that irrespective of the amount the lead used during writing, the slider 16 is always advanced up to the predetermined or constant position and a predetermined constant length of lead is every time provided from the front end of the slider 16.

If it is desired not to use the tip sleeve, for example, where soft paper is to be used, it is possible to supply lead little by little and to write in the same manner as a mechanical pencil which is not of the slide type by a simple operation in which the rear axial body 8 is rotated in the opposite direction to a small extent and then returned in the initial direction. This operation is evident from the foregoing description and thus a detailed explanation need not be given.

To bring the mechanical pencil to its retracted position after use, only a simple rotation in the opposite direction is needed. Such an operation is believed evident from the foregoing description and a further explanation is not necessary. In the second embodiment, since the lead is not gripped by the chuck 20 in the retracted state, lead breakage is rarely caused during the carrying state.

Any excessive lead extending from the front end of the tip sleeve 36 in the retracted state may be retracted simply by pushing the end of the lead against a solid surface. In this case, the tip sleeve 36 is retracted to coincide with the mount member 2 which operation is easily conducted since the lead is not gripped by the chuck 20. Since any excessive lead can be retracted as shown in FIG. 4, it is possible to save the excessive supply of lead for the next writing operation.

Figure 8:
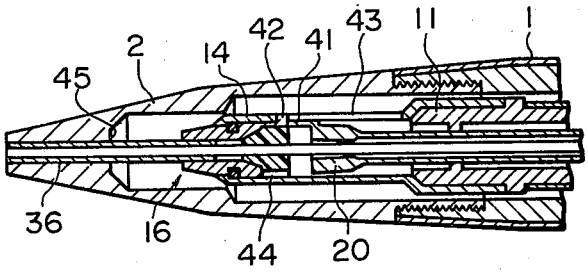
FIGS. 8–10 are longitudinal cross-sectional views of a third embodiment of a mechanical pencil according to the present invention shown in various operational states.
Figure 9:
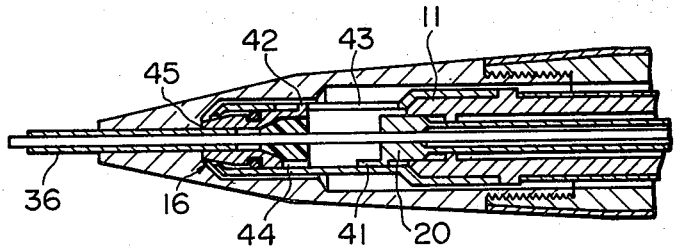
Figure 10:
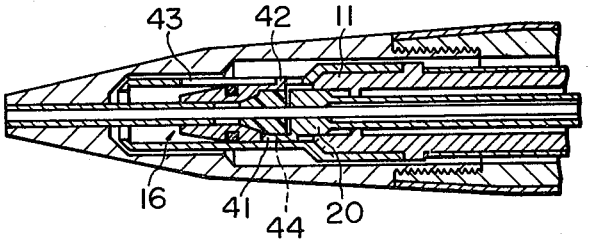

FIGS. 8 to 10 show a further embodiment of a mechanical pencil according to the present invention. The mechanical pencil of this embodiment is so designed that when the rear axial body 8 is rotated, the chuck 20 is also rotated therewith. An extension rod 41 is formed on a front end of the chuck 20. A projection 42 is formed on an outer periphery of the slider 16 and is engaged with an axial slot formed in the cylindrical sleeve 14 to thereby prevent rotation of the slider 16. An engagement hole 44 is formed in a rear end portion of the slider 16.

Since in the retracted state shown in FIG. 8 the extension rod 41 of the chuck 20 is not engaged with the engagement hole 44 of the slider 16, the front end of the slider 16 coincides with the front end of the mouth member 2 and in this state the slider is prevented from moving rearwardly. When the rear axial body 8 is rotated, the cylindrical sleeve 14, the tightening member 11 and the slider 16 are moved forwardly. After the front end of the slider 16 has come into abutment with a shoulder portion 45 formed adjacent to a front inner end of the mouth member 2 as is thereby stopped from moving further forward, the tightening member clamping the chuck 20 is advanced to thereby supply a short length of lead from the tip end of the tip sleeve 36. It should be noted that the chuck 20 is rotated through an angle of approximately 180° to attain the state shown in FIG. 9. From this state, writing can be continued up to the state shown in FIG. 10 where the slider 16 has been completely retracted and the extension rod 41 of the slider 16 is in the position shown in FIG. 10. If no engagement hole 44 of the slider 16 were provided, since the rear end of the slider 16 moves backward due to writing it would come into abutment with the front end of the chuck 20 which is advanced a distance corresponding to the lead extension length from the tip end of the slider 16 and therefore the slider 16 could not then be moved further backwards. As a result, it would not be impossible to continue writing until the tip sleeve 36 of the slider 16 is completely retracted into the mouth member 2. If the tip sleeve 36 could not retract into the mouth member 2, the paper could be torn by the tip sleeve 36 during writing.

Figure 11:
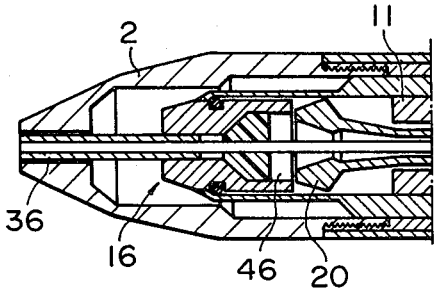
FIGS. 11–13 are longitudinal cross-sectional views of a fourth embodiment of a mechanical pencil according to the present invention shown in various operational states.
Figure 12:
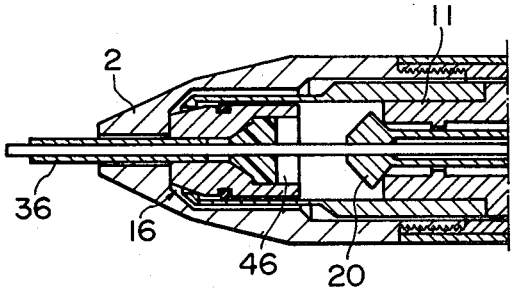
Figure 13:
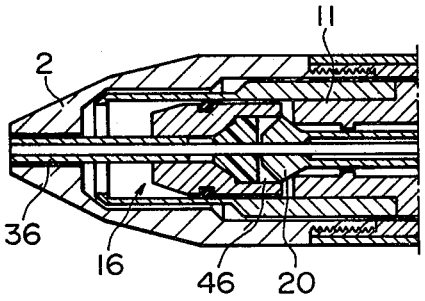

FIG. 11 is a fragmentary longitudinal cross-sectional view showing a fourth embodiment of a mechanical pencil constructed according to the present invention. In this embodiment, a hollow space 46 is defined behind the rear end of the slider 16. The tip end portion of the chuck 20 is shaped such that, when the slider 16 is moved fully rearward due to writing, the end portion of the chuck 20 can fit within the hollow space 46 as shown in FIG. 12. In FIG. 11 showing a retracted state, the chuck 20 is opened with the rear end of the slider 16 abutting against the front end of the chuck 20. In FIG. 12 showing a writing state, as the slider 16 gradually moves rearward during writing, the hollow space 46 defined in the slider 16 receives the front end portion of the chuck whereby writing is possible until the tip sleeve 36 is completely within the mouth member 2 as shown in FIG. 13. Consequently, to reach the retracted state shown in FIG. 11, the rear end portion of the slider 16, which is surrounded by the chuck 20, is pushed away by slant surfaces formed at the end portion of the chuck.

Preferred embodiments of the invention have been described. It is, however, believed evident that the invention is not limited to these particular embodiments. For example, although in the embodiments described a cam or spiral type mechanism is used for moving the tightening member 11 back and forth when either axial body is rotated, it is understood that various other mechanisms may be used instead and the particular mechanisms shown and the invention is not limited by the specific preferred embodiments. Also, in the preferred embodiments described, the mechanical pencil body is divided into two groups either of which may be rotated relative to the other. It is, therefore, understood that either axial body member may be made rotatable by a rotation transmission mechanism in order to cause the tightening member 11 to move back and forth. In addition, many modifications may be used for various parts or members of the mechanical pencil.

As is apparent from the foregoing description, by rotating either the front or rear axial body member, the tightening member is advanced to engage the chuck causing it to grip the lead so that continuous writing is possible. Since in the writing state a distance defined between the front end of the chuck and the front-most end of the pencil body is made equal to or greater than the extended length of the slider or tip sleeve, it is possible to continue writing until the slider or tip sleeve is completely retracted into the pencil body. Furthermore, since in the retracted state, the front end of the slider 16 is aligned with or slightly retracted from the front end of the pencil body, if the slider with lead extending from the opening thereof is retracted into the pencil body, the end of the lead can easily be retracted by pushing it against a solid surface. Accordingly, during the next use, excessive lead supply is avoided.

What is claimed is:

1. A rotational slide type mechanical pencil comprising: a hollow axial body composed of first and second bodies, said first and second bodies being rotatable relative to each other; a lead case for storage of extra leads disposed within and fixed to said hollow axial body; a chuck for firmly clamping a lead during writing, said chuck being rigidly coupled to said lead case; a chuck tightening member having a chuck receiving portion for engaging and tightening said chuck, said tightening member being disposed in said first axial body; slider means for frictionally gripping said lead, said slider means being movable back and forth through a predetermined distance within said axial body and said slider means being disposed in front of said chuck; and a conversion mechanism for converting rotational movement of said second axial body to linear movement of said chuck tightening member whereby rotational movement of said second axial body relative to said first axial body moves said slider means forwardly extending a portion of said slider means from a front opening of said axial hollow body, wherein said hollow body is provided with a hollow space in which said chuck tightening member is movable between a first position and a second position, said chuck tightening member being biased towards said first position, a hollow cylindrical sleeve being provided extending forwardly from a front end of said chuck tightening member, said hollow cylindrical sleeve frictionally retaining said slider means in a front portion thereof, said chuck in said first position being disengaged from said chuck tightening member and said chuck in said second position being engaged with said chuck tightening member, and in said second position, said slider means being fully retractable into said hollow body upon said lead being worn during writing.

2. The mechanical pencil as defined in claim 1 wherein said slider means is provided with retaining means which abuts said front portion of said hollow cylindrical sleeve to restrain movement of said slider means forwardly beyond said second position.

3. The mechanical pencil as defined in claim 1 wherein said chuck is biased rearwardly through said axial body, said slider means being adapted to abut against an inner portion of said axial body when said chuck tightening member is advanced before said chuck tightening member reaches said second position to thereby provide new lead from a front opening of said axial body, the front-most end of said axial body and the front end of the slider means coinciding with each other in said first position and the slider means being fully retractable into said axial body in said second position.

4. The mechanical pencil as defined in claim 3 further comprising an annular member having an inwardly directed annular projection, said annular member being disposed inside a front portion of said axial body, and said slider means comprising a tip sleeve and a retaining ring member disposed around an outer periphery of said tip sleeve at a position to abut said annular projection in said first position.

5. The mechanical pencil as defined in claim 3 wherein said chuck is rotatable in response to rotation of said second body, said chuck having an extension rod extending from the front end of said chuck, said extension rod being adapted to about the rear end of said slider means at said first position, and said slider means having an engagement hole adapted to receive said extension rod in said second position.

6. The mechanical pencil as defined in claim 3 wherein said chuck is self-biased to be open and abuts against the rear end of said slider means at said first position, said slider means having a concave portion adapted to receive a front portion of said chuck thereinto, and said front portion of said chuck being insertable into said concave portion of said slider means in said second position.

7. The mechanical pencil as defined in claim 3, 4, 5 or 6 wherein said chuck tightening member is movable from said first position to a third position prior to moving to said second position, said chuck being engaged and movable with said chuck tightening member when said chuck tightening member is moved from said third position to said second position so as to extend a predetermined length of said lead from said front-most end of said slider means.

* * * * *